US006076186A

United States Patent [19]

Grose

[11] Patent Number: 6,076,186

[45] Date of Patent: Jun. 20, 2000

[54] CRIB CLIMBING RESTRAINT GARMENT FOR TODDLERS

[76] Inventor: Patricia C. Grose, 13501 Golden Corn Dr., Highland, Md. 20777

[21] Appl. No.: 09/264,127

[22] Filed: Mar. 5, 1999

[51] Int. Cl.[7] ..... A41D 11/00; A41D 10/00

[52] U.S. Cl. ..... 2/75; 2/80; 2/83; 2/114

[58] Field of Search ..... 2/75, 80, 83, 69.5, 2/111, 114

[56] References Cited

U.S. PATENT DOCUMENTS

| | | | |
|---|---|---|---|
| 541,995 | 7/1895 | Denton . | |
| 569,521 | 10/1896 | Scatchard . | |
| 779,809 | 1/1905 | Sherick . | |
| 1,159,788 | 11/1915 | Newbell . | |
| 1,556,747 | 10/1925 | Bates . | |
| 2,130,771 | 9/1938 | Mann . | |
| 2,234,546 | 3/1941 | Basch . | |
| 2,250,750 | 7/1941 | Cole . | |
| 2,307,266 | 1/1943 | Hansen | 2/114 |
| 2,374,299 | 4/1945 | O'Hara | 2/75 |
| 2,441,900 | 5/1948 | Oswald . | |
| 2,442,192 | 5/1948 | Bookbinder . | |
| 2,444,652 | 7/1948 | Joyce . | |
| 2,496,922 | 2/1950 | Virtue . | |
| 2,511,809 | 6/1950 | Ryan . | |
| 2,535,936 | 12/1950 | Langley . | |
| 2,546,057 | 3/1951 | Bodin et al. . | |
| 2,562,061 | 7/1951 | Peterson . | |
| 2,611,131 | 9/1952 | Heeter | 2/69.5 |
| 2,613,359 | 10/1952 | Boyce | 2/69.5 |
| 2,652,052 | 9/1953 | Smith . | |
| 2,723,398 | 11/1955 | Tuteur . | |
| 2,888,009 | 5/1959 | Taylor . | |
| 3,093,132 | 6/1963 | Bailey . | |
| 4,295,230 | 10/1981 | Blodgett | 2/69.5 |
| 4,901,371 | 2/1990 | Christians | 2/69.5 |
| 5,243,724 | 9/1993 | Barnes | 5/482 |
| 5,621,917 | 4/1997 | Howsden | 2/111 |

*Primary Examiner*—John J. Calvert
*Assistant Examiner*—Shirra L. Jenkins

[57] ABSTRACT

A garment for restraining a toddler from climbing out of a crib has a sack-like body with upper neck and arm openings, the neck opening being temporarily enlargeable to enable the toddler to be put in and taken out. The sack-like body is permanently closed except for the neck and arm openings. A crotch portion may be spaced intermediate an elasticated waist portion and the bottom of the sack-like body which may be made of tightly woven fabric. Leg loops may be provided inside the sack-like body.

23 Claims, 3 Drawing Sheets

CRIB CLIMBING RESTRAINT GARMENT FOR TODDLERS

FIELD OF INVENTION

This invention relates to garments to be worn by toddlers when in their cribs or playpens, particularly at sleep times.

BACKGROUND OF THE INVENTION

Adventurous toddlers, say between one and three years old, at some time become successful at climbing out of their cribs and placing themselves in many possible dangers. This is of particular concern when the toddlers are thought to be sleeping in their cribs, for example during the night, or even napping in their playpens.

Although this is of particular concern to parents, this problem does not appear to have been effectively addressed.

SUMMARY OF THE INVENTION

This invention is concerned with providing a garment, particularly a sleep-time garment, that will function as a crib climbing restraint to effectively address the above problem.

At the same time, the invention is concerned with providing such a garment that is also comfortable and non-restrictive to promote restful sleep.

According to one aspect of the invention, therefore, there is provided a garment comprising a front, back, closed lower end, and closed sides. At the upper end is a neck opening with an arm opening on either side. The front and back each extend between the closed sides and from the closed lower end to the neck opening. The front is secured to the back at a location between the closed lower end and the neck opening and spaced intermediate the closed sides to provide a crotch portion.

To facilitate putting the garment on and taking it off a toddler, the neck opening is preferably temporarily enlargeable such as for example by a short zipper at the back of the neck opening. Preferably, the garment forms a permanently closed sack except for the englargeable neck opening and the arm openings.

Advantageously, an elasticated waist portion may be provided intermediate the crotch portion and the neck opening.

Advantageously, the fabric of the garment can be a non-stretch fabric to provide more effective restraint on the toddler's climbing ability.

Preferably, the garment is made of a single piece of tightly woven fabric for strength.

The crotch portion may comprise a crotch seam including a strip of reinforcing tape and is preferably four to eight inches long in the lengthwise direction of the garment.

Preferably, the crotch portion may comprise two spaced apart side-by-side crotch seams which preferably diverge towards the closed lower end of the garment. The upper ends of these two crotch seams may be connected by a third crotch seam to form a somewhat inverted U-shaped crotch seam.

According to another aspect of the present invention there is provided a garment for restraining a toddler from climbing out of a crib, the garment comprising a sack having a front, back, neck opening and two arm openings. A short slit in the back communicates with the neck opening for enlarging the neck opening just sufficiently for inserting the toddler into and removing the toddler from the sack, the slit being releasably closable but out of the reach of the toddler while in the sack which is completely and permanently closed except for the arm openings and the enlargeable neck opening. The sack is made of strong, non-stretchable material, for example a tightly woven fabric. The toddler while wearing the sack in the crib has leg separation movement restricted and is restrained from climbing out of the crib.

The garments may have internal leg loops.

Other objects, features and advantages of the present invention will become more fully apparent from the following detailed description of the preferred embodiments, the appended claims and the accompanying drawings.

BRIEF DESCRIPTION OF THE DRAWINGS

In the accompanying drawings, in which like reference characters in the same or different Figures indicate like parts.

DETAILED DESCRIPTION OF THE PREFERRED EMBODIMENTS

Figure 1:
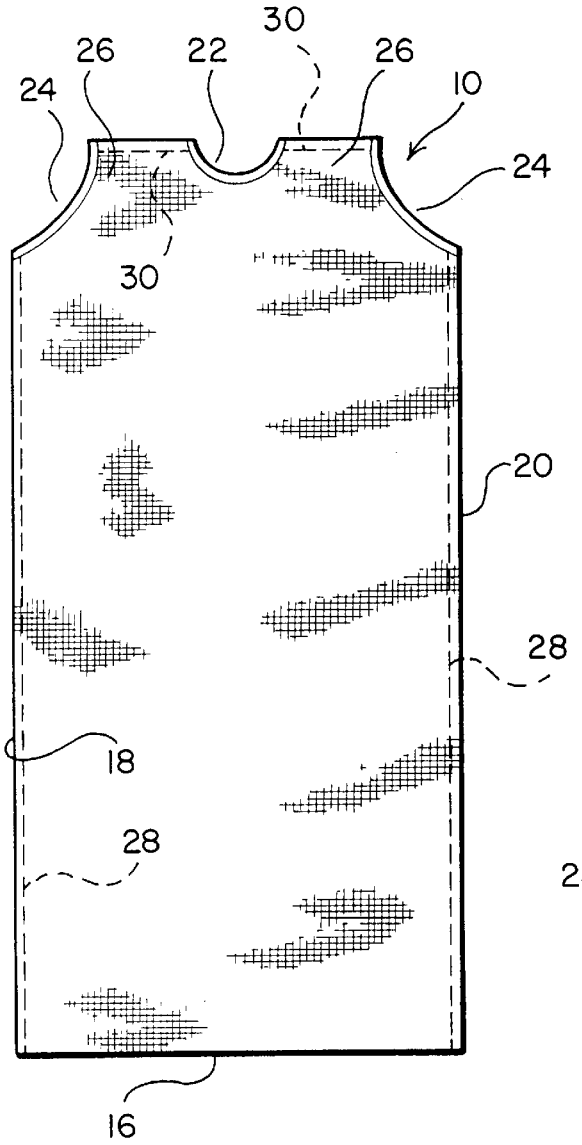
FIG. 1 is a front view of a first embodiment of a toddler crib climbing restraint garment according to the invention.
Figure 2:
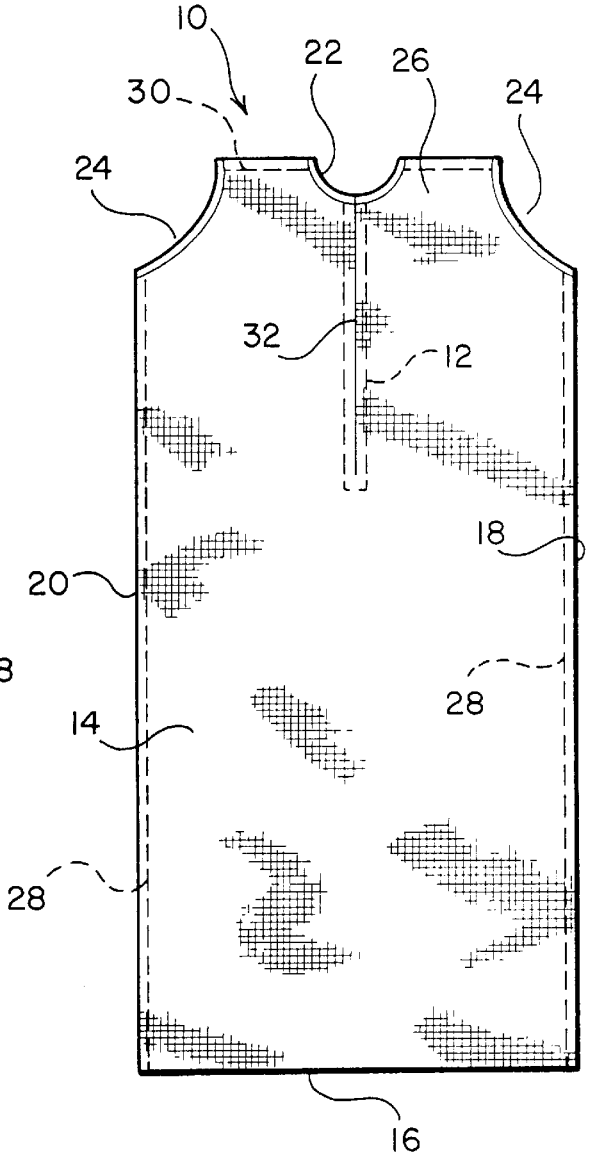
FIG. 2 is a back view of the garment of FIG. 1.
Figure 5:
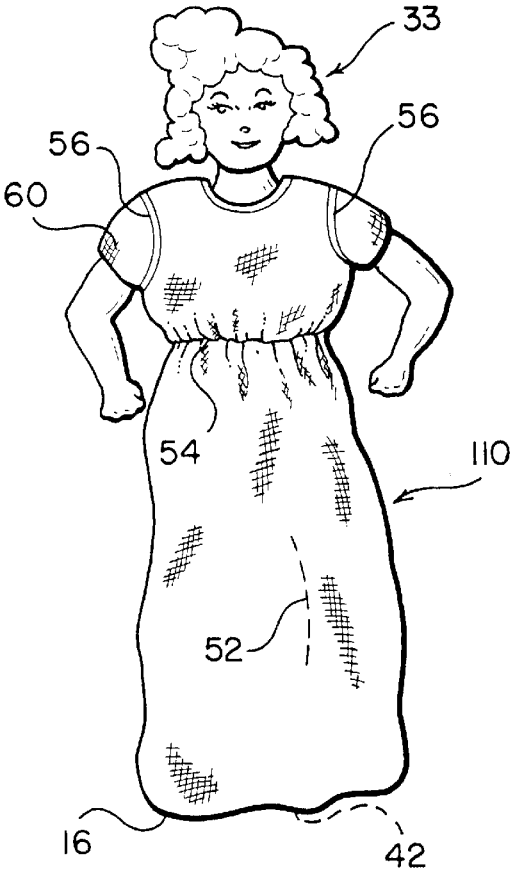
FIG. 5 is a front view of the embodiment of FIG. 4 as worn by a toddler.
Figure 6:
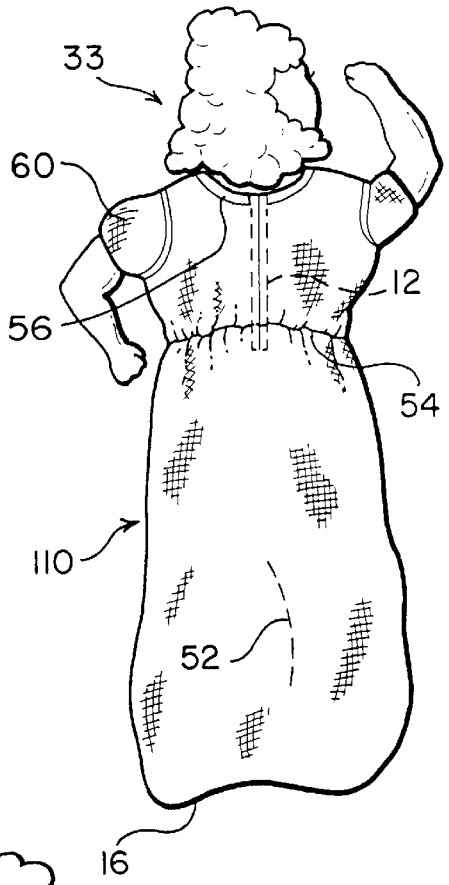
FIG. 6 is a rear view of the embodiment of FIGS. 4 and 5 as worn by the toddler.
Figure 3:
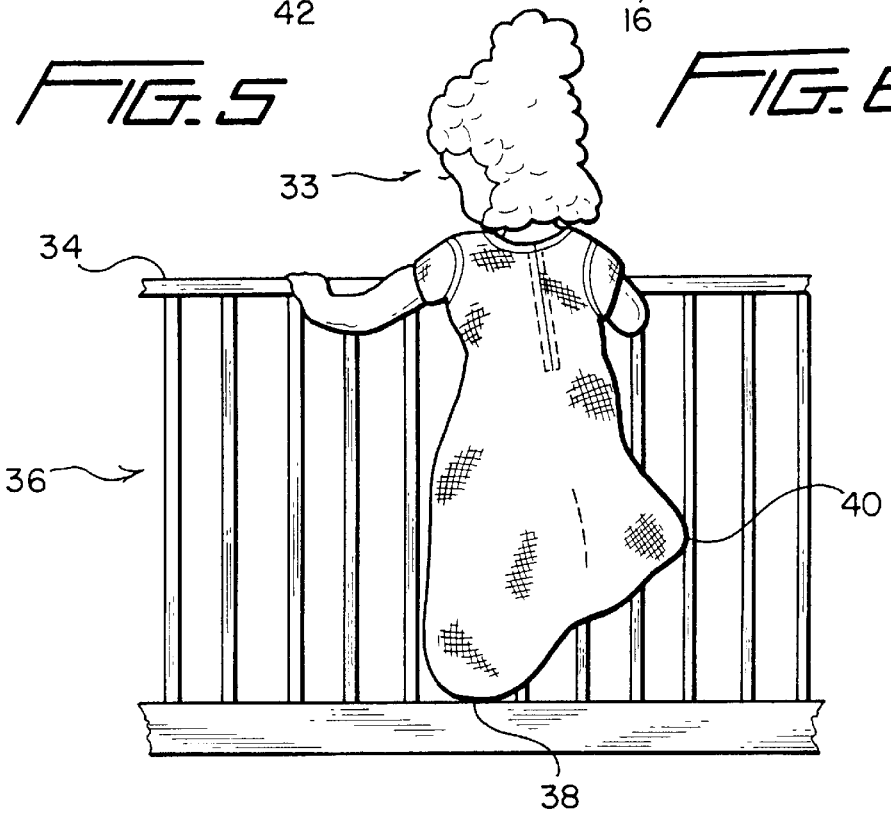
FIG. 3 illustrates a garment according to the invention restraining a toddler from climbing out of a crib.
Figure 4:
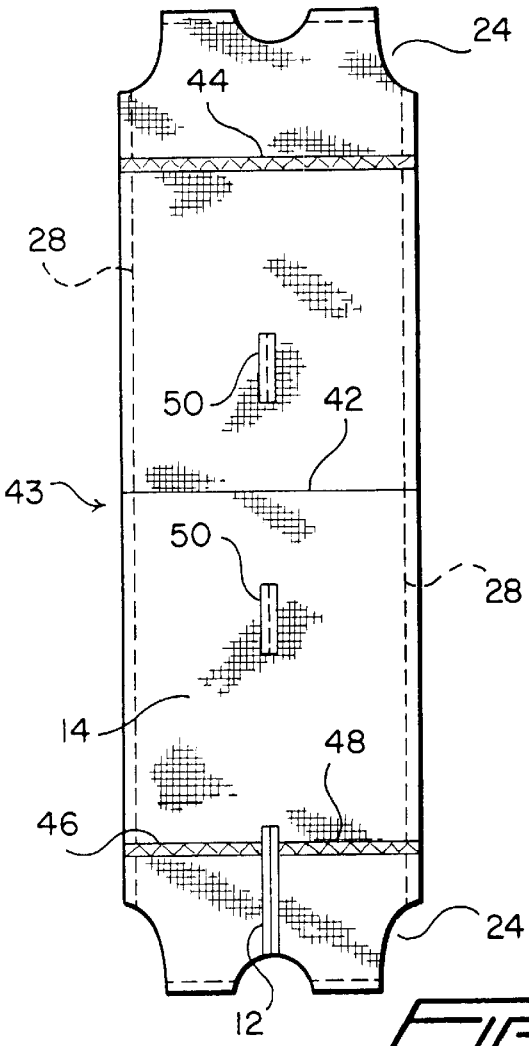
FIG. 4 is a plan view of the inside of a second embodiment of the invention before folding and final seaming.
Figure 7:
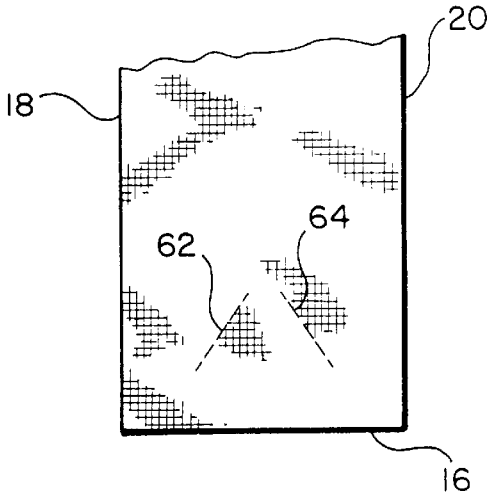
FIG. 7 is a simplified partial front view of a first modification of the two embodiments of FIGS. 1 to 6.
Figure 8:
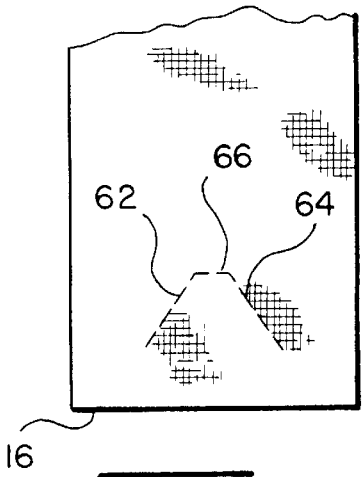
FIG. 8 is a similar partial front view of a second modification of the two embodiments of FIGS. 1 to 6.
Figure 9:
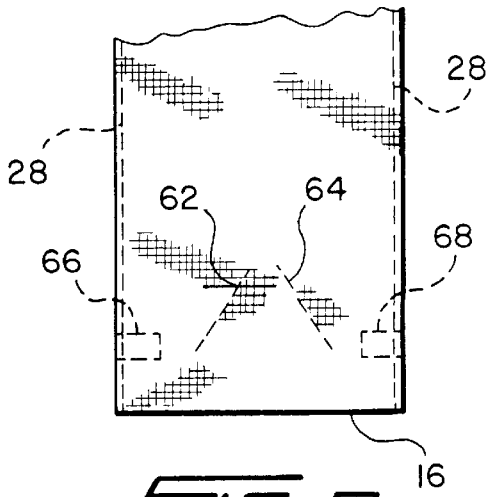
FIG. 9 is a similar partial front view of a third modification of the two embodiments of FIGS. 1 to 6.

FIGS. 1 to 6 illustrate two embodiments of the present invention, FIG. 3 illustrating the effectiveness of both embodiments, and the preferred embodiment being that of FIGS. 4 to 6. FIGS. 7 to 9 illustrate three modifications applicable to both the embodiments, the preferred modification being that of FIG. 9.

FIGS. 1 and 2 show the first embodiment of the crib climbing restraint garment 10 respectively in front and back views which are essentially identical except for a zipper 12 in the back 14. The garment 10 is sack-like having a body made from one piece of material and having a closed bottom 16, closed parallel sides 18, 20, neck opening 22, and two arm openings 24. The three openings are at the upper end of the garment with the pair of arm openings 24 on opposite sides of neck opening 22. Shoulder portions 26 are defined on either side of the neck opening 22 by the arm openings 24.

The sack-like body is made from a single strip of fabric shaped as shown in FIG. 4. The fabric strip is folded upon itself (in FIG. 4 on the fold line 42) so that the fold forms the closed bottom 16. The super-imposed side edges are sewn together to form side seams 28. Back and front shoulder portions are also sewn together to form shoulder seams 30. The zipper 12 is sewn in a slit 32 in the back 14 extending downwards about twelve inches from the center of the back of the neck opening 22. The width of the garment 10 may be approximately a third to half the length. Typically the garment 10 is essentially a rectangle, for example, about 40 inches long and about 19 inches wide, although it may taper inwardly towards the closed lower end 16. Advantageously for strength, the fabric of the garment 10 is a tightly woven fabric, for example of cotton and/or cotton/polyester.

Appropriate trim is sewn around the neck and arm openings 22, 24, for example ribbing trim.

The seams 28, 30 are flat seams for comfort and double sewn for strength. The zipper 12 is preferably a twelve inch plastic separating zipper.

In use, the zipper 12 is unzipped to enlarge the neck opening 22, the toddler inserted feet first through the enlarged neck opening, the toddler's arms moved outwardly through the arm openings 24, and then the zipper 12 zipped up to close the neck opening 22 around the toddler's neck. The toddler, dressed in their normal night attire, has freedom of movement of their body and legs inside the sack-like garment with their arms and head outside the garment. This enables the toddler to be comfortable when sleeping or resting in a crib. However, should the toddler try to climb out of the crib, the width of the lower portion of the sack-like garment limits the separation of the legs of the toddler so restricting the ability of the toddler to get a foot or a leg up on top of a top rail of the crib. This is illustrated in FIG. 3; the toddler 33 is shown wearing a garment according to the invention and hanging onto a top rail 34 of the crib 36, while standing on one foot inside a bottom corner 38 of the garment. In this position, the toddler cannot get their other foot (or the knee of that leg) up onto the top rail 34 due to the configuration of the garment. This other foot is restrained by the other bottom corner 40 and/or the lower side portion of the garment. It has been observed that the infant usually needs to get a foot, knee or leg on or over the top rail 34 in order to climb out of the crib.

FIG. 4 shows an intermediate step in the fabrication of the second embodiment of the invention. This shows a plan view of the inside of the garment material before being folded upon itself about the central fold line 42. A strip of strong material, advantageously a tightly woven fabric, is cut as shown, and the back zipper 12 inserted as previously described in relation to FIG. 2. So far, the shaped fabric 43 is identical to that used to form the garment of FIGS. 1 and 2 and is folded and sewn in the same way as described in relation to FIGS. 1 and 2 to form a garment 110 (FIGS. 5 and 6) similar to garment 10. However, garment 110 has two additional features; an elasticated waist (54, FIGS. 5 and 6) and a crotch portion (52, FIGS. 5 and 6).

The elasticated waist is positioned at or just above the natural waistline, and is formed by three elastic strips 44, 46, 48 sewn to the inside of the shaped fabric 43, the strip 44 extending fully across the front and the two shorter strips 46, 48 extending across the back 14 on each side of the zipper 12. The outer ends of the strip 44 are sewn to outer ends of the strips 46, 48 when the side seams 28 are sewn.

The crotch portion or connection is formed centrally of the width of the fabric 43 and partway between the elasticated waist line and the bottom fold 42. Two short lengths of twill reinforcing tape 50, for example five inches long, are sewn to the inside of the fabric 43 of the garment 110 at the crotch location, as shown in FIG. 4. After the fabric 43 has been folded about the fold line 42, the two lengths of now superimposed tape 50 are strongly sewn together as can be seen in FIGS. 5 and 6 at 52. As can be appreciated from FIGS. 4 to 6, the crotch portion 52 is roughly midway between the elasticated waist 54 and the bottom fold line 42, completely spaced from but nearer the bottom fold line 42.

FIGS. 5 and 6 illustrate the garment 110 being worn by the toddler 33 over a typical night attire garment 60. The zipper 12 can be seen extending downwardly to just below the elasticated waist 54. The elasticated waist 54 gathers in the upper part of the sack-like garment. The crotch connection 52, while permitting free movement of the toddler's feet and legs inside the sack-like garment, further limits separation of the feet and legs within the garment 110 and provides better climbing restraint than the garment 10. The combination of the elasticated waist 54 and the crotch connection 52 provides even further climbing restraint while the elasticated waist improves the comfort of the garment.

The construction and fabric of the garments are chosen primarily for strength as the garment is a safety garment for restraining toddlers from climbing out of their cribs or playpens.

Strips 56 of stretch cotton ribbing fabric are sewn around the neck and arm openings for a more attractive finish to the garment. Also, the fabric could have brightly colored shapes on it to interest the toddler, e.g. animals, toys etc., and for educational benefit letters and numbers.

FIGS. 7 and 8 illustrate modifications to the crotch connection 52, and can be employed with both of the embodiments of FIGS. 1 to 6. In FIG. 7 the crotch connection is formed by two stitched crotch seams 62, 64 (preferably including reinforcing tape as before) securing the back and front of the sack together. These two seams 62, 64 are spaced apart a short distance and diverge outwardly towards the sack bottom 16. This provides a "softer" crotch portion than the single crotch seam in FIGS. 5 and 6 and is intended to be more comfortable, particularly for larger toddlers. It also provides improved crib climbing restraint, particularly limiting the raising of a knee.

In FIG. 8 a similar crotch connection to that in FIG. 7 is shown, but the upper ends of the two seams 62, 64 are connected by a stitched seam portion 66. Thus, a somewhat inverted U-shaped crotch seam is provided.

FIG. 9 shows a further modification in which two closed leg loops 66, 68 are located inside the sack-like body in the vicinity of a lower portion of the crotch connection 62, 64. These leg loops 66, 68 may be formed of stretch ribbing and are sewn in the side seams 28. As the toddler is placed in the sack-like garment, the toddler's legs are gently placed through these loops 66, 68. This is for added restraint against separation of the legs, particularly if the toddler raises one or both knees. However, if the leg loops were to be bypassed, the garment would still function as before. These leg loops are illustrated with the crotch connection of FIG. 7, but could also be employed with the crotch connections of FIG. 8 and FIG. 4. The leg loops 66, 68 could also be advantageously used in the embodiment of FIGS. 1 and 2 without a crotch connection.

All seams (including the seam or seams of the crotch connection) are strongly sewn, preferably reinforced seams such as a French seam or a sewn seam plus zig-zag oversewn.

Apart from sewing, the seams could be formed or connected by other means, e.g. textile adhesive, bonding, etc.

Desirably the fabric of the sack is strong and has the ability to breathe. As the sack-like garment is intended to be worn over normal sleepware, for all year round use, a strong light-weight fabric can advantageously be used. Although for safety against being undone by the toddler, the back zipper 12 is preferred, other neck and/or shoulder closures could be employed, e.g. Velcro strips such as hook and loop fastners. Although it is preferred to have simple arm openings, puffs or sleeves could be added. Further, the sack-like body could be folded about a side fold line instead of a bottom fold line, or could be made of two or more pieces of fabric. Although not preferred, the crotch connection could extend downwardly to the closed bottom 16 of the sack-like garment 10, 110.

As will be appreciated, these garments do not stop the toddlers from moving about, crawling, standing, and walking. Also, the open space, when provided, in the sack between the crotch connection and the bottom 16 allows the toddler to cross over their feet inside the sack. However, the garment limits the toddler's ability to raise a leg and lift it onto the top rail of a crib, the essential first step before the toddler can pull itself over the top rail. The toddler is restrained from lifting a leg up far enough to get the needed leverage to climb out.

It should be noted that when the crotch feature is included, the sizing of the garment to the toddler is less important, and a garment that is a bit big for the toddler can still provide the necessary climbing restraint.

The above described embodiments, of course, are not to be construed as limiting the breadth of the present invention. Modifications, and other alternative constructions, will be apparent which are within the spirit and scope of the invention as defined in the appended claims.

What is claimed is:

1. A garment, comprising:

a front, a back, a closed lower end, closed sides, and upper end openings;

said upper end openings comprising arm openings on opposite sides of a neck opening;

said front and said back each extending between said closed sides and extending from said closed lower end to said neck opening; and said front being secured to said back at a discrete location intermediate said closed lower end and said neck opening and spaced intermediate said closed sides.

2. The garment of claim 1, wherein shoulder portions are defined between said neck opening and said arm openings.

3. The garment of claim 1, wherein a zipper extends from said neck opening down a portion of said back.

4. The garment of claim 1, further comprising leg loops attached inside the garment and disposed above said closed lower end between said closed sides and said location.

5. The garment of claim 1, wherein said neck opening is temporarily enlargeable to enable a toddler to be placed in and removed from the garment through the temporarily enlarged neck opening.

6. The garment of claim 5, wherein said garment forms a permanently closed sack except for said enlargeable neck opening and said arm opening.

7. The garment of claim 1, wherein said garment is sack-like and has an elasticated waist portion intermediate said neck opening and said location.

8. The garment of claim 7, wherein said front, back, lower end and sides are made of a single piece of non-stretch fabric.

9. The garment of claim 1, wherein said front, back, lower end and sides are made of tightly woven fabric.

10. The garment of claim 1, wherein said garment is sack-like and at said location said front is secured to said back by a crotch connection.

11. The garment of claim 10, wherein said crotch connection comprises two spaced apart seams diverging outwardly towards said closed lower end.

12. A garment for a toddler, comprising:

a sack-like body having a closed lower end, closed sides, and upper end openings;

said upper end openings comprising arm openings on opposite sides of a neck opening;

shoulder pieces between the neck opening and the arm openings;

said sack-like body having a front and a back each extending between said closed sides and also extending from said closed lower end to said neck opening; and a crotch connection securing said front to said back at a location spaced intermediate said closed sides and also spaced intermediate said closed bottom and said neck opening, whereby a toddler wearing the garment while resting in a crib is restricted from separating their legs sufficiently to easily climb out of the crib.

13. The garment of claim 12, wherein said body is made of non-stretch fabric, and said sides and said bottom are permanently closed.

14. The garment of claim 13, wherein said fabric is a tightly woven fabric.

15. The garment of claim 12, wherein said neck opening is temporarily enlargeable to enable the toddler to be placed in and taken out of the sack-like body.

16. The garment of claim 15, wherein the temporary enlargement of the neck opening is effected by an openable slit in said back.

17. The garment of claim 16, wherein said slit is openable and closable by a zipper.

18. A garment for restraining a toddler from climbing out of a crib, comprising:

a sack-like body having a closed lower end, closed sides, and an upper neck opening;

said neck opening being temporarily enlargeable to enable the toddler to be placed in and taken out of the garment;

an elasticated waist portion intermediate said lower end and said neck opening; and a crotch portion spaced intermediate said sides and intermediate said waist portion and said lower end and connecting said front to said back.

19. The garment of claim 18, wherein said crotch portion comprises two diverging seams.

20. The garment of claim 18, further comprising leg loops attached to said sack-like body adjacent said crotch portion.

21. A garment for restraining a toddler from climbing out of a crib, comprising:

a sack having a neck opening and two arm openings;

said neck opening being temporarily enlargeable for inserting the toddler into and removing the toddler from the sack through the neck opening;

said sack being completely and permanently closed except for the arm openings and the enlargeable neck opening; and said sack being made of tightly woven material for strength and non-stretchability, and a front portion secured to a back portion at a location intermediate a pair of sides and intermediate and upper end and a lower end whereby the toddler while wearing the sack in the crib has leg separation movement restricted and is restrained from climbing out of the crib.

22. The garment of claim 21, further comprising a pair of leg loops attached inside said sack.

23. The garment of claim 21, wherein said sack has an elasticated waist.

* * * * *